US011403979B2

(12) United States Patent
Levinson

(10) Patent No.: US 11,403,979 B2
(45) Date of Patent: Aug. 2, 2022

(54) DYNAMIC PERSISTENCE FOR JUDDER REDUCTION

(71) Applicant: Apple Inc., Cupertino, CA (US)

(72) Inventor: Louis E. Levinson, Half Moon Bay, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/884,261

(22) Filed: May 27, 2020

(65) Prior Publication Data

US 2020/0402435 A1 Dec. 24, 2020

Related U.S. Application Data

(60) Provisional application No. 62/863,916, filed on Jun. 20, 2019.

(51) Int. Cl.
*G09G 3/04* (2006.01)

(52) U.S. Cl.
CPC ..... *G09G 3/04* (2013.01); *G09G 2320/0233* (2013.01); *G09G 2320/0261* (2013.01); *G09G 2320/0626* (2013.01)

(58) Field of Classification Search
None
See application file for complete search history.

(56) References Cited

U.S. PATENT DOCUMENTS

| | | | | |
|---|---|---|---|---|
| 9,407,797 | B1 | 8/2016 | Newell et al. | |
| 2011/0317072 | A1 | 12/2011 | Miyachi et al. | |
| 2012/0113307 | A1 * | 5/2012 | Watanabe ..... | H04N 5/23293 348/333.01 |

(Continued)

FOREIGN PATENT DOCUMENTS

| | | | |
|---|---|---|---|
| CN | 102082896 | A | 6/2011 |
| CN | 105185284 | A | 12/2015 |
| CN | 106210767 | A | 12/2016 |
| CN | 108701438 | A | 10/2018 |
| CN | 109032541 | A | 12/2018 |
| CN | 109196578 | A | 1/2019 |

OTHER PUBLICATIONS (CN) The State Intellectual Property Office of the People's Republic of China, Patent Search Report (with English translation), Chinese Patent Application No. 202010562080.5, 6 pages, dated Feb. 22, 2022.

(Continued)

*Primary Examiner* — Aneeta Yodichkas
(74) *Attorney, Agent, or Firm* — Thompson Hine LLP

(57) ABSTRACT

Implementations disclosed herein provide improved systems and methods for displaying video that has at least some content in the same position in consecutive frames. In some implementations, such content is low frame rate video content altered for display on a display at a higher refresh rate. Judder is reduced or avoided by selectively altering one or more of the consecutive frames, for example, so that the consecutive frames have differences in brightness, color, luminance, or dynamic range. For example, given three consecutive frames of repeated content, the first frame of may be displayed at a 100% brightness level, the second frame may be displayed at 50% brightness, and the third frame may be displayed at 25% brightness. Such differences in brightness or other display characteristics may reduce or avoid the appearance of judder while preserving the overall appearance of the video.

21 Claims, 6 Drawing Sheets

(56) References Cited

U.S. PATENT DOCUMENTS

| | | | | |
|---|---|---|---|---|
| 2012/0154466 | A1* | 6/2012 | Kitada | G09G 3/3426 345/694 |
| 2014/0085276 | A1* | 3/2014 | Jang | G09G 3/2007 345/204 |
| 2014/0267370 | A1 | 9/2014 | Albrecht et al. | |
| 2015/0340012 | A1* | 11/2015 | Lee | G06T 11/60 345/589 |
| 2015/0348509 | A1 | 12/2015 | Verbeure et al. | |
| 2017/0098406 | A1 | 4/2017 | Kobayashi | |
| 2017/0110069 | A1 | 4/2017 | Shoshan et al. | |
| 2017/0352322 | A1 | 12/2017 | Spence et al. | |
| 2018/0338104 | A1 | 11/2018 | Pines et al. | |
| 2019/0180713 | A1 | 6/2019 | Zhu et al. | |
| 2020/0082511 | A1* | 3/2020 | Leem | H04N 5/44504 |

OTHER PUBLICATIONS (CN) The State Intellectual Property Office of the People's Republic of China, Notification of the First Office Action (English translation), Chinese Patent Application No. 202010562080.5, 2 pages, Feb. 28, 2022.

* cited by examiner

DYNAMIC PERSISTENCE FOR JUDDER REDUCTION

CROSS-REFERENCE TO RELATED APPLICATIONS

This application claims the benefit of U.S. Provisional Application Ser. No. 62/863,916 filed Jun. 20, 2019, which is incorporated herein in its entirety.

TECHNICAL FIELD

The present disclosure generally relates to providing content on electronic devices, and in particular, to systems, methods, and devices for improving the presentation of any frame-based content displayable via an electronic device.

BACKGROUND

Judder refers to perceived uneven or jerky video playback that often arises because of the movement of objects in a video or the movement of a camera when a video was captured. Judder is sometimes perceived when viewing low frame rate video content (e.g., cinema content recorded at 24 images per second) on displays with higher refresh rates (e.g., on televisions configured to refresh at 60 images per second). In such circumstances, the display supplements the missing frames by generating duplicate frames, e.g., displaying the first frame three times, then the second frame two times, then the third frame three times, etc. The repeated display of one frame multiple frames followed by a switch to displaying the next frame multiple times may result in content that should appear to have a smooth movement (e.g., when the camera pans) actually appearing to have a jerky or stuttering movement. This issue may be exacerbated in circumstances in which the number of repeats is not equal across the original frames. For example, converting 24 frames into 60 frames may involve repeating twelve frames of the 24 frames twice (e.g., shown 3 times in a row) and repeating the other twelve frames of the 24 frames only once (e.g., shown 2 times in a row). Higher peak image brightness has also been found to potentially exacerbate judder.

SUMMARY

Implementations disclosed herein provide systems and methods for displaying video that may have at least some content in the same position in consecutive frames. In some implementations, such content is low frame rate video content altered for display on a display at a higher refresh rate. For example, 24 frame per second content may be shown on a display capable of 96 frame per second refresh. Judder is reduced or avoided by selectively altering one or more of the consecutive frame refreshes, for example, so that the consecutive frames have differences in display characteristics. Judder may be reduced using temporarily asymmetric image processing, e.g., asymmetric in time. Content that persists in the same location across multiple consecutive frames may be dynamically altered to have differences in brightness, color, luminance, dynamic range, etc. For example, given three consecutive frames of repeated content, the first frame may be displayed at a 100% brightness level, the second frame may be displayed at 50% brightness, and the third frame may be displayed at 25% brightness. In the example of 24 frame per second content to be shown on a display capable of 96 frame per second refresh, each frame may be repeated four times and the brightness or other display characteristics of some or all of those repetitions may be adjusted. Such differences in brightness or other display characteristics may reduce or avoid the appearance of judder while preserving the overall appearance of the video.

Some implementations provide a method of providing a video that includes consecutive frames having display characteristics that reduce or avoid judder. The exemplary method may be implemented by a computing device executing instructions using a processor. The method identifies a subset of consecutive frames of a video of frames that have content that appears in a same position. For example, this may involve identifying that a frame of 24 frame per second content will be displayed three consecutive times in a video that will be displayed at a higher refresh rate. In another example, this involves identifying that a particular object appears at the same location for multiple consecutive frames even though other portions are different in these frames.

The method alters a display characteristic (e.g., brightness, luminance, color, etc.) to display the content differently in the consecutive frames of the subset of consecutive frames. In some implementations, the display characteristic is altered for the entire frame, e.g., all pixels have reduced brightness, while in other implementations particular objects or locations within the frame are selectively altered. The selection of particular objects or locations within the consecutive frames to selectively alter may be based on identifying objects or locations that satisfy brightness criteria (e.g., above a threshold brightness), identifying objects that move relative to a stable background during the video, or other criteria. In the example of 24 frame per second content to be shown on a display capable of 96 frame per second refresh, each frame may be repeated four times and the brightness or other display characteristics of a particular object in some or all of those repetitions may be adjusted. The method displays the video including the consecutive frames having the altered display characteristics.

In accordance with some implementations, a non-transitory computer readable storage medium has stored therein instructions that are computer-executable to perform or cause performance of any of the methods described herein. In accordance with some implementations, a device includes one or more processors, a non-transitory memory, and one or more programs; the one or more programs are stored in the non-transitory memory and configured to be executed by the one or more processors and the one or more programs include instructions for performing or causing performance of any of the methods described herein.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

DESCRIPTION

Figure 2:
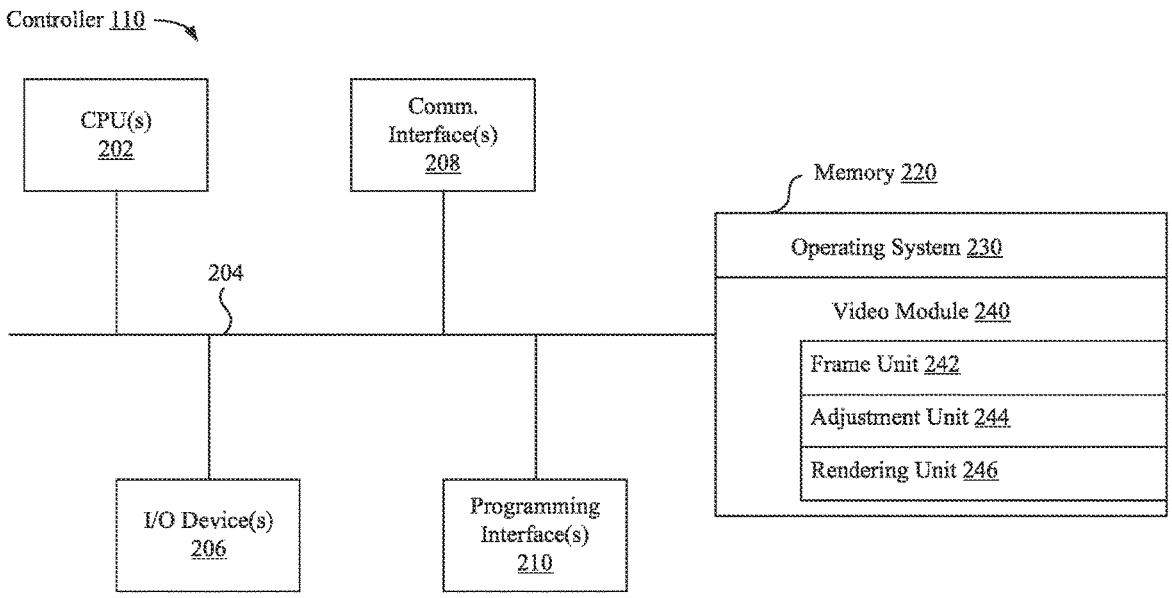
FIG. 2 is a block diagram of an example controller in accordance with some implementations.
Figure 3:
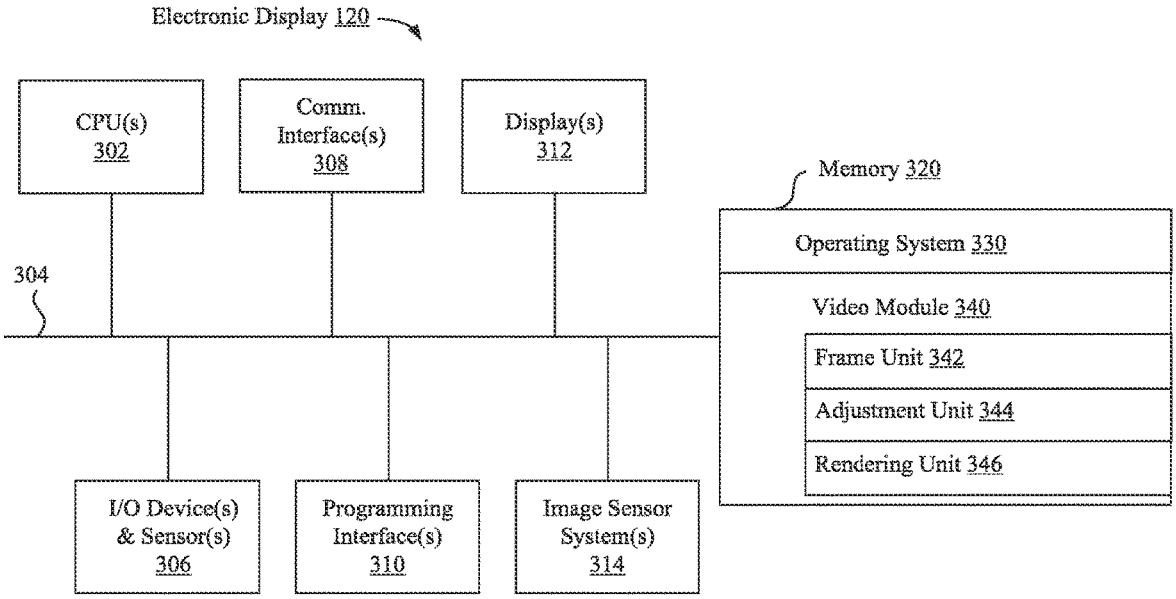
FIG. 3 is a block diagram of an example electronic device in accordance with some implementations.

Numerous details are described in order to provide a thorough understanding of the example implementations shown in the drawings. However, the drawings merely show some example aspects of the present disclosure and are therefore not to be considered limiting. Those of ordinary skill in the art will appreciate that other effective aspects or variants do not include all of the specific details described herein. Moreover, well-known systems, methods, components, devices and circuits have not been described in exhaustive detail so as not to obscure more pertinent aspects of the example implementations described herein. While FIGS. 1-3 depict exemplary implementations involving a handheld electronic device, other implementations do not necessarily involve an handheld device and may involve other types of devices including, but not limited to, televisions, set-top devices, laptops, desktops, gaming devices, home automation devices, watches, head-mounted devices (HMDs), and other wearable electronic devices, and other devices that process or display video.

Figure 1:
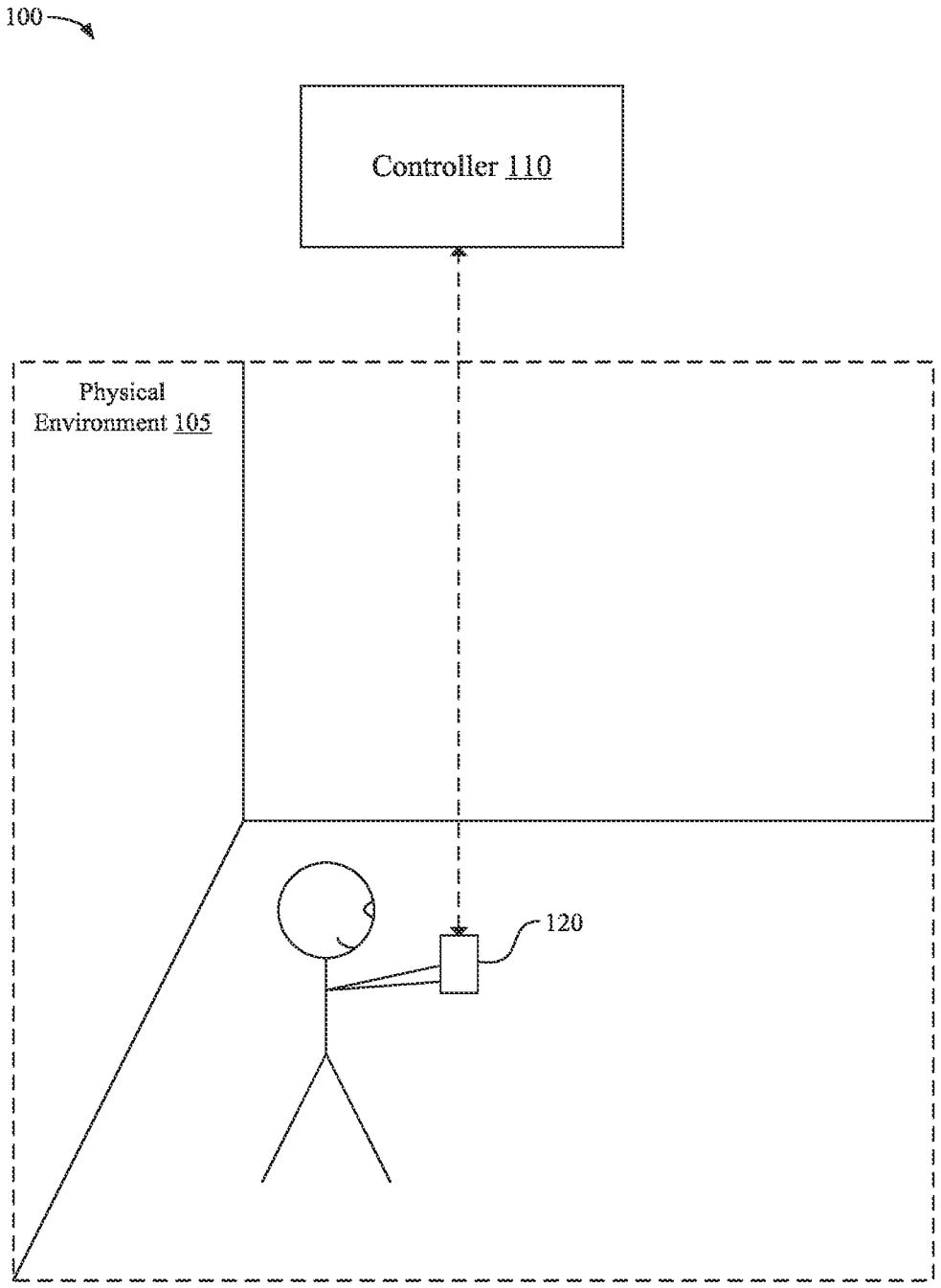
FIG. 1 is a block diagram of an example operating environment in accordance with some implementations.

FIG. 1 is a block diagram of an example operating environment 100 in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the operating environment 100 includes a controller 110 and an electronic device 120, one or both of which may be in a physical environment.

The electronic device 120 is configured to process or display video content. In some implementations, the electronic device 120 includes a suitable combination of software, firmware, or hardware. The term "video" as used herein refers to any frame-based content displayable via an electronic device. The video content may be provided for display on the electronic device 120 from a recorded source or a live source. For example, a video may be stored in a memory on the electronic device 120, the controller 110, or elsewhere. In another example, a video may be a stream of frames captured or processed in real time by a camera on the electronic device 120, the controller 110, or elsewhere. The electronic device 120 is described in greater detail below with respect to FIG. 3. In some implementations, the functionalities of the controller 110 are provided by or combined with the electronic device 120, for example, in the case of an electronic device that functions as a stand-alone unit.

In some implementations, the controller 110 is a computing device that is local or remote relative to the physical environment 105. In one example, the controller 110 is a local server located within the physical environment 105. In another example, the controller 110 is a remote server located outside of the physical environment 105 (e.g., a cloud server, central server, etc.). In some implementations, the controller 110 is communicatively coupled with the electronic device 120 via one or more wired or wireless communication channels 144 (e.g., BLUETOOTH, IEEE 802.11x, IEEE 802.16x, IEEE 802.3x, etc.).

FIG. 2 is a block diagram of an example of the controller 110 in accordance with some implementations. While certain specific features are illustrated, those skilled in the art will appreciate from the present disclosure that various other features have not been illustrated for the sake of brevity, and so as not to obscure more pertinent aspects of the implementations disclosed herein. To that end, as a non-limiting example, in some implementations the controller 110 includes one or more processing units 202 (e.g., microprocessors, application-specific integrated-circuits (ASICs), field-programmable gate arrays (FPGAs), graphics processing units (GPUs), central processing units (CPUs), processing cores, or the like), one or more input/output (I/O) devices 206, one or more communication interfaces 208 (e.g., universal serial bus (USB), FIREWIRE, THUNDERBOLT, IEEE 802.3x, IEEE 802.11x, IEEE 802.16x, global system for mobile communications (GSM), code division multiple access (CDMA), time division multiple access (TDMA), global positioning system (GPS), infrared (IR), BLUETOOTH, ZIGBEE, or the like type interface), one or more programming (e.g., I/O) interfaces 210, a memory 220, and one or more communication buses 204 for interconnecting these and various other components.

In some implementations, the one or more communication buses 204 include circuitry that interconnects and controls communications between system components. In some implementations, the one or more I/O devices 206 include at least one of a keyboard, a mouse, a touchpad, a joystick, one or more microphones, one or more speakers, one or more image capture devices or other sensors, one or more displays, or the like.

The memory 220 includes high-speed random-access memory, such as dynamic random-access memory (DRAM), static random-access memory (SRAM), double-data-rate random-access memory (DDR RAM), or other random-access solid-state memory devices. In some implementations, the memory 220 includes non-volatile memory, such as one or more magnetic disk storage devices, optical disk storage devices, flash memory devices, or other non-volatile solid-state storage devices. The memory 220 optionally includes one or more storage devices remotely located from the one or more processing units 202. The memory 220 comprises a non-transitory computer readable storage medium. In some implementations, the memory 220 or the non-transitory computer readable storage medium of the memory 220 stores the following programs, modules and data structures, or a subset thereof including an optional operating system 230 and computer-generated reality (CGR) module 240.

The operating system 230 includes procedures for handling various basic system services and for performing hardware dependent tasks.

In some implementations, the video module 240 includes a frame unit 242, an adjustment unit 244, and a rendering unit 246. The frame unit 242 is configured to identify frames for inclusion in a video. In some implementations, the frame unit 242 identifies a subset of consecutive frames of a video of frames that have content that appears in a same position. For example, this may involve identifying that a frame of 24 frame per second content will be displayed three consecutive times in a video that will be displayed at a higher refresh rate. In another example, this involves identifying that a particular object appears at the same location for multiple consecutive frames even though other portions are different in these frames.

The adjustment unit 244 alters a display characteristic (e.g., brightness, luminance, color, etc.) to display the content differently in consecutive frames of a video content. In some implementations, the display characteristic is altered for the entire frame, e.g., all pixels have reduced brightness, while in other implementations particular objects or locations within the frame are selectively altered. The selection of particular objects or locations within the consecutive frames to selectively alter may be based on identifying objects or locations that satisfy brightness criteria (e.g., above a threshold brightness), identifying objects that move relative to a stable background during the video, or other criteria.

The rendering unit 246 provides videos for display, including videos that have consecutive frames identified by the frame unit 242 and altered by the adjustment unit 244.

Although these modules and units are shown as residing on a single device (e.g., the controller 110), it should be understood that in other implementations, any combination of these modules and units may be located in separate computing devices. Moreover, FIG. 2 is intended more as functional description of the various features which are present in a particular implementation as opposed to a structural schematic of the implementations described herein. As recognized by those of ordinary skill in the art, items shown separately could be combined and some items could be separated. For example, some functional modules shown separately in FIG. 2 could be implemented in a single module and the various functions of single functional blocks could be implemented by one or more functional blocks in various implementations. The actual number of modules and the division of particular functions and how features are allocated among them will vary from one implementation to another and, in some implementations, depends in part on the particular combination of hardware, software, or firmware chosen for a particular implementation.

FIG. 3 is a block diagram of an example of the electronic device 120 in accordance with some implementations. While certain specific features are illustrated, those skilled in the art will appreciate from the present disclosure that various other features have not been illustrated for the sake of brevity, and so as not to obscure more pertinent aspects of the implementations disclosed herein. To that end, as a non-limiting example, in some implementations the electronic device 120 includes one or more processing units 302 (e.g., microprocessors, ASICs, FPGAs, GPUs, CPUs, processing cores, or the like), one or more input/output (I/O) devices and sensors 306, one or more communication interfaces 308 (e.g., USB, FIREWIRE, THUNDERBOLT, IEEE 802.3x, IEEE 802.11x, IEEE 802.16x, GSM, CDMA, TDMA, GPS, IR, BLUETOOTH, ZIGBEE, SPI, I2C, or the like type interface), one or more programming (e.g., I/O) interfaces 310, one or more displays 312, one or more interior or exterior facing image sensor systems 314, a memory 320, and one or more communication buses 304 for interconnecting these and various other components.

In some implementations, the one or more communication buses 304 include circuitry that interconnects and controls communications between system components. In some implementations, the one or more I/O devices and sensors 306 include at least one of an inertial measurement unit (IMU), an accelerometer, a magnetometer, a gyroscope, a thermometer, one or more physiological sensors (e.g., blood pressure monitor, heart rate monitor, blood oxygen sensor, blood glucose sensor, etc.), one or more microphones, one or more speakers, a haptics engine, one or more depth sensors (e.g., a structured light, a time-of-flight, or the like), or the like.

In some implementations, the one or more displays 312 are configured to present an CGR experience to the user. In some implementations, the one or more displays 312 correspond to holographic, digital light processing (DLP), liquid-crystal display (LCD), liquid-crystal on silicon (LCoS), organic light-emitting field-effect transitory (OLET), organic light-emitting diode (OLED), surface-conduction electron-emitter display (SED), field-emission display (FED), quantum-dot light-emitting diode (QD-LED), micro-electromechanical system (MEMS), or the like display types. In some implementations, the one or more displays 312 correspond to diffractive, reflective, polarized, holographic, etc. waveguide displays. For example, the electronic device 120 includes a single display. In another example, the electronic device 120 includes a display for each eye of the user.

The memory 320 includes high-speed random-access memory, such as DRAM, SRAM, DDR RAM, or other random-access solid-state memory devices. In some implementations, the memory 320 includes non-volatile memory, such as one or more magnetic disk storage devices, optical disk storage devices, flash memory devices, or other non-volatile solid-state storage devices. The memory 320 optionally includes one or more storage devices remotely located from the one or more processing units 302. The memory 320 comprises a non-transitory computer readable storage medium. In some implementations, the memory 320 or the non-transitory computer readable storage medium of the memory 320 stores the following programs, modules and data structures, or a subset thereof including an optional operating system 330 and a computer-generated reality (CGR) module 340.

The operating system 330 includes procedures for handling various basic system services and for performing hardware dependent tasks.

In some implementations, the video module 340 includes a frame unit 342, an adjustment unit 344, and a rendering unit 346. The frame unit 342 is configured to identify frames for inclusion in a video. In some implementations, the frame unit 342 identifies a subset of consecutive frames of a video of frames that have content that appears in a same position. For example, this may involve identifying that a frame of 24 frame per second content will be displayed three consecutive times in a video that will be displayed at a higher refresh rate. In another example, this involves identifying that a particular object appears at the same location for multiple consecutive frames even though other portions are different in these frames.

The adjustment unit 344 alters a display characteristic (e.g., brightness, luminance, color, etc.) to display the content differently in consecutive frames of a video content. In some implementations, the display characteristic is altered for the entire frame, e.g., all pixels have reduced brightness, while in other implementations particular objects or locations within the frame are selectively altered. The selection of particular objects or locations within the consecutive frames to selectively alter may be based on identifying objects or locations that satisfy brightness criteria (e.g., above a threshold brightness), identifying objects that move relative to a stable background during the video, or other criteria.

The rendering unit 346 provides videos for display, including videos that have consecutive frames identified by the frame unit 342 and altered by the adjustment unit 344.

Moreover, FIG. 3 is intended more as a functional description of the various features which are present in a particular implementation as opposed to a structural schematic of the implementations described herein. As recognized by those of ordinary skill in the art, items shown separately could be combined and some items could be separated. For example, some functional modules shown separately in FIG. 3 could be implemented in a single module and the various functions of single functional blocks could be implemented by one or more functional blocks in various implementations. The actual number of modules and the division of particular functions and how features are allocated among them will vary from one implementation to another and, in some implementations, depends in part on the particular combination of hardware, software, or firmware chosen for a particular implementation.

Figure 4:
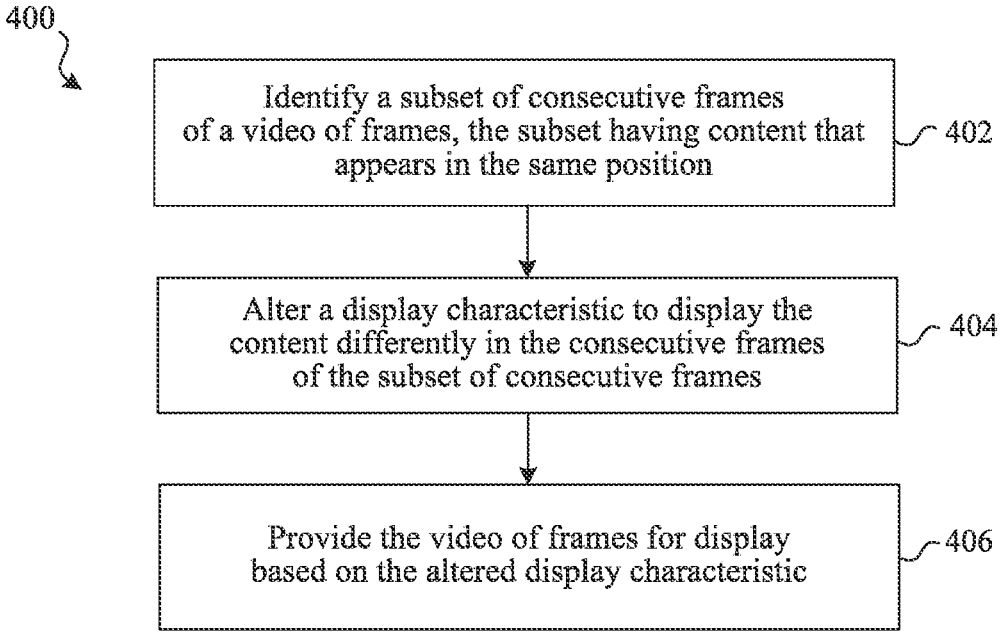
FIG. 4 is a flowchart illustrating an exemplary method of providing a video that includes consecutive frames having display characteristics that reduce or avoid judder according to some implementations.

FIG. 4 is a flowchart illustrating an exemplary method of providing a video that includes consecutive frames having display characteristics that reduce or avoid judder. In some implementations, the method 400 is performed by a device (e.g., controller 110 or electronic device 120 of FIGS. 1-3). The method 400 can be performed at a television, set-top box, mobile device, HMD, desktop, laptop, server device, or by multiple devices in communication with one another. In some implementations, the method 400 is performed by processing logic, including hardware, firmware, software, or a combination thereof. In some implementations, the method 400 is performed by a processor executing code stored in a non-transitory computer-readable medium (e.g., a memory).

At block 402, the method 400 involves identifying a subset of consecutive frames of a video of frames, the subset having content that appears in a same position. Thus, if each of the consecutive frames includes color values for pixel locations in a grid of pixel locations, the consecutive frames may have the same or similar values for the pixel locations corresponding to the content. Identifying the subset of consecutive frames may involve identifying that a frame of 24 frame per second content will be displayed three consecutive times in a video that will be displayed at a higher refresh rate. Identifying the subset of consecutive frames may be a part of a process (e.g., an up-conversion process) that generates duplicate frames to provide additional frames for use in displaying relatively-low frame rate content on a relatively higher refresh rate display.

In another example, identifying the consecutive frames involves identifying that a particular object appears at the same location for multiple consecutive frames even though other portions are different in these frames. For example, the color values for pixels of frames of the video may be compared to identify groups of the same or similar pixel values indicative of an object remaining at a same relative location in consecutive frames.

At block 404, the method 400 involves altering a display characteristic (e.g., brightness, luminance, color, etc.) to display the content differently in the consecutive frames of the subset of consecutive frames. In some implementations, the display characteristic is altered for the entire frame, e.g., all pixels have reduced brightness. In one example, altering the display characteristic of one or more frames of consecutive frames involves determining a first brightness for a first frame of the consecutive frames, determining a second brightness for a second frame of the consecutive frames, where the second frame is after the first frame in a sequence of the consecutive frames. The first frame may be altered according to the first brightness or the second frame may be altered according to the second brightness, or both. The first brightness may be the original brightness of the frame and the second brightness may be increased or decreased. The second brightness may be the original brightness of the frame and the first brightness may be increased or decreased. Both the first brightness and the second brightness may be changed, e.g., both increased, both decreased, or one increased and the other decreased.

In some implementations, a group of consecutive frames is selected for alteration based on criteria, e.g., based on brightness/luminance level discrimination. For example, a first frame group including frame A repeated 3 times may be selected for alteration while a second frame group including frame B repeated 3 times may not be selected for alteration based on the overall luminance or peak luminance of frame A satisfying a brightness threshold and the overall luminance or peak luminance of frame B not satisfying the brightness threshold. In some implementations, only groups of frames having high brightness peaks are selected for alteration such that overall the method 400 provides compression of highlights.

In some implementations, particular objects or locations within the frame are selectively altered, e.g., based on spatial discrimination. In some implementations, the method determines to alter the display characteristic of a first object depicted in a frame and to not alter a second object depicted in the frame based on object altering selection criteria.

In some implementations a frame is altered to adjust the brightness, color, or other display characteristic of a particular object. In some implementations, a frame is altered to reposition a particular object. For example, if an object moves from left to right in a sequence of 3 frames (e.g., F1, F2, F3) of 24 frame per second content and additional frames are generated to provide content for display at 96 frames per second (e.g., F1, F1b, F1c, F1d, F2, F2b, F2c, F2d, F3, F3b, F3c, F3d), the position of the object in the added frames may be moved. The object may be positioned in F1b slightly to the right of its position in F1. The object may be positioned in F1c slightly to the right of its position in F1b. The object may be positioned in F1d slightly to the right of its position in F1c and slightly to the left of its position in F2. In this way, the position of the object as it moves may be more uniform along a movement in smaller incremental steps, reducing the appearance of judder. Moving an object with a frame may involve detecting the object (e.g., its outline), moving the object relative to other content in the frame, and filling in empty space resulting from the movement. The empty space may be filled using a machine-learning based or other appropriate techniques. One exemplary techniques using the two original frames to fill the empty space, e.g., using content from F2 to fill in a portion of F1b when the object is moved in F1b.

The selection of particular objects or locations within the consecutive frames to selectively alter may be based on identifying objects or locations that satisfy brightness/luminance level criteria. In one example, for a first frame, all pixel locations may remain at their original brightness. In the example, for a second frame, pixel values having a brightness value above a threshold brightness value are reduced to the threshold value, to a predetermined maximum, by a predetermined value, or by a predetermined threshold. Reducing the brightness of only the brighter portions of a consecutive frame may help avoid the appearance of judder without reducing the quality of video.

The selection of particular objects or locations within the consecutive frames to selectively alter may be based on identifying objects or locations that satisfy movement criteria. In one example, movement of objects is determined using a vector motion map that can be interpreted to identify objects that are moving and objects that are not moving. In another example, a vector motion map is used to estimate speeds at which objects are moving or accelerations at which objects are accelerating and the speed or accelerations are used to identify which objects or locations to selectively alter.

In another example, an original video may contain a sequence of 20 frames during which a car is depicted moving from the left side to the right side as the car drives down the street. The background in the frame, in this example, remains relatively constant since the camera was not moved while the video was captured. In this example, the car may be identified as a moving object. The sequence of frames may be used to create video for display at a higher resolution (e.g., having 60 frames instead of the original 20) and thus some of the frames of the video will be consecutive frames having the car content at the same position, e.g., three frames with the car at position A then three frames with the car at position B then three frames with the car at position C, etc. In this example, the consecutive frames are identified by identifying the car as a moving object and then identifying that the car content remains at the same location in consecutive frames.

At block 406, the method 400 involves providing the video of frames for display based on the altered display characteristic. For example, this may involve displaying a first frame of the consecutive frames using a first brightness, the second frame of the consecutive frame at a second brightness, etc., where the first and second brightness are the altered display characteristics.

In some implementations, a user provides a preference or other input to control how much display characteristics are altered to account for judder. Individual users may be relatively more or less perceptive of or otherwise concerned with judder and thus some users may opt for more significant judder-reducing alterations than other users.

Figure 5:
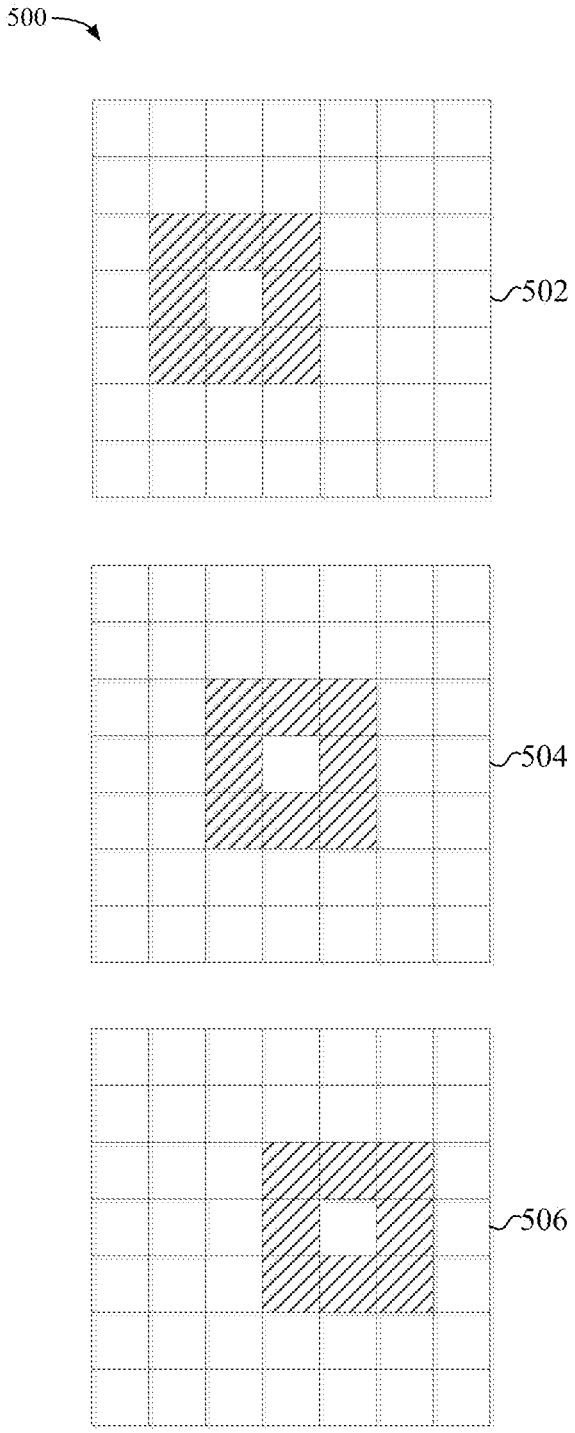
FIG. 5 is a block diagram illustrating exemplary frames of low frame rate video content.

FIG. 5 is a block diagram illustrating exemplary frames 500 of low frame rate video content. In this example, frame 502 depicts an object at a left position, frame 504 depicts the object at a middle position, and frame 506 depicts the object at a right position.

Figure 6:
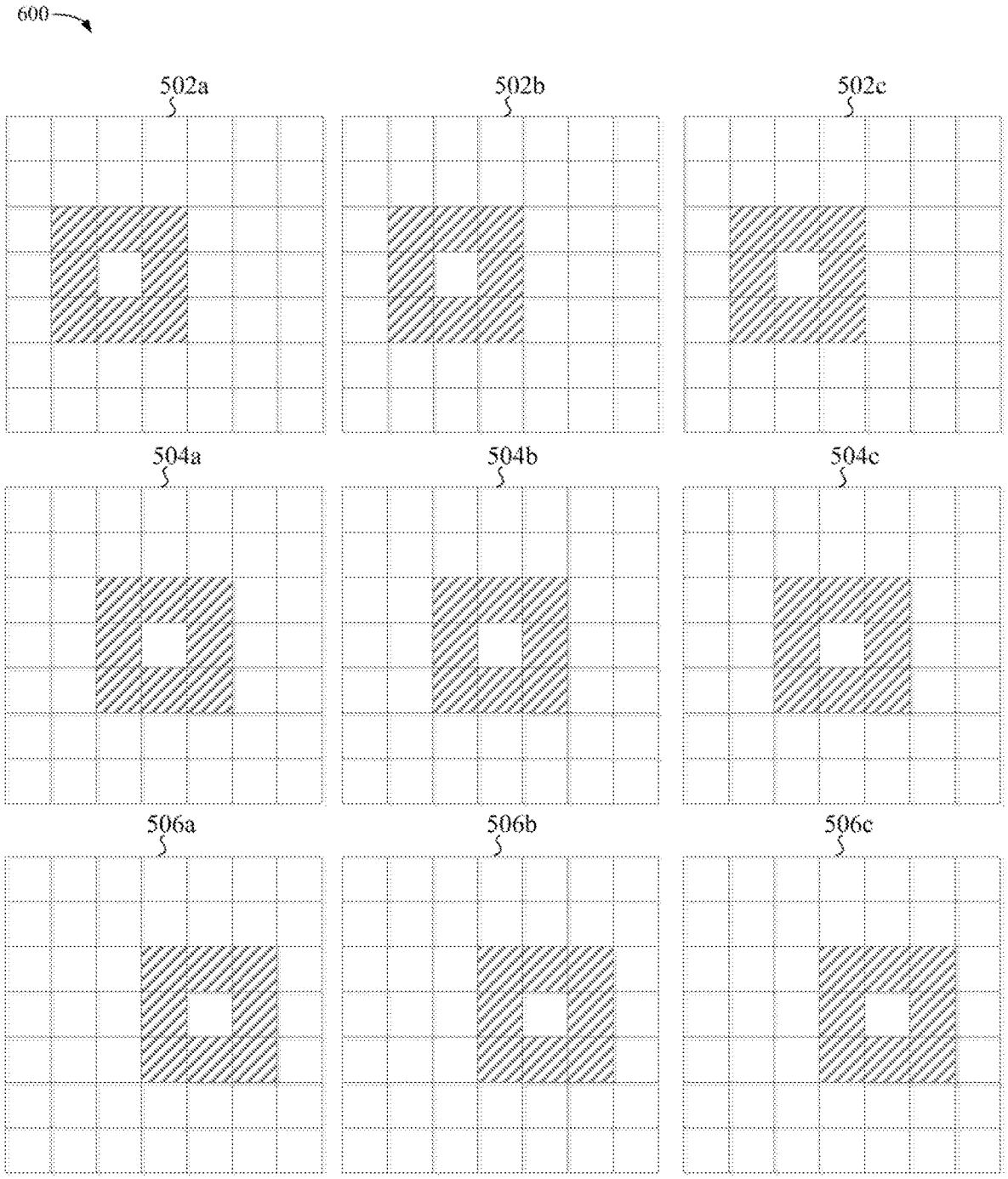
FIG. 6 is a block diagram illustrating set of frames generated by repeating the frames of the low frame rate video content of FIG. 5 to provide video for display at a higher refresh rate.

FIG. 6 is a block diagram illustrating a set of nine frames 600 generated by repeating the frames 500 of the low frame rate video content of FIG. 5 to provide video for display at a higher refresh rate. Frame 502 is repeated three times as frames 502*a*, 502*b*, and 502*c*. Frame 504 is repeated three times as frames 504*a*, 504*b*, and 504*c*. In this example, the set of nine frames 600 could be played as a video by displaying the nine frames in the sequence of frame 502*a* then frame 502*b* then frame 502*c* then frame 504*a* then frame 504*b* then frame 504*c* then frame 506*a* then frame 506*b* then frame 506*c*. However, displaying the frames in this sequence without altering the display characteristics may result in an appearance of judder with the object appearing to lurch from the left position to the middle position to the right position over time.

Figure 7:
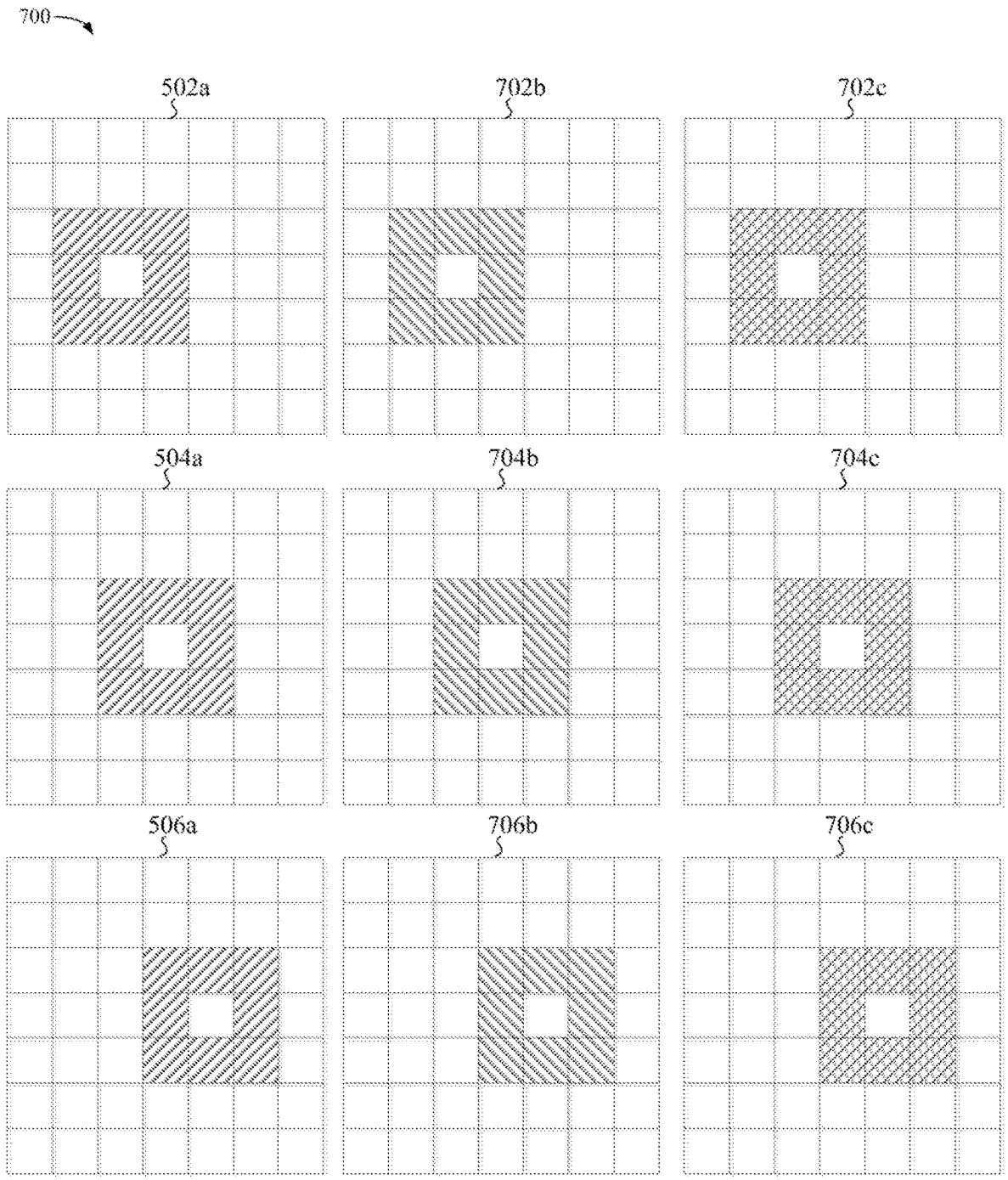
FIG. 7 is a block diagram illustrating altering display characteristics of the consecutive frames of the set of frames of FIG. 6 to reduce or avoid judder according to some implementations In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

FIG. 7 is a block diagram illustrating altering the display characteristics of the consecutive frames of the set of nine frames 600 of FIG. 6 to reduce or avoid judder according to some implementations. In this example, the first frame in each group of consecutive frames (e.g., frame 502*a*, frame 504*a*, and frame 506*a*) are not altered.

The second frame in each group of frames (e.g., frame 502*b*, frame 504*b*, and frame 506*b* of FIG. 6) are replaced with altered versions having altered display characteristics (e.g., as frame 702*b*, frame 704*b*, and frame 706*b*). In this example, the brightness of frame 702*b* is less than the brightness of frame 502*b*, the brightness of frame 704*b* is less than the brightness of frame 504*b*, and the brightness of frame 706*b* is less than the brightness of frame 506*b*. For example, the maximum brightness of each of these frames 702*b*, 704*b*, and 706*b* may be set to 50% of the maximum brightness value.

The third frame in each group of frames (e.g., frame 502*c*, frame 504*c*, and frame 506*c* of FIG. 6) are replaced with altered versions having altered display characteristics (e.g., as frame 702*c*, frame 704*c*, and frame 706*c*). In this example, the brightness of frame 702*c* is less than the brightness of frame 502*c*, the brightness of frame 704*c* is less than the brightness of frame 504*c*, and the brightness of frame 706*c* is less than the brightness of frame 506*c*. For example, the maximum brightness of each of these frames 702*b*, 704*b*, and 706*b* may be set to 25% of the maximum brightness value.

The brightness of frame 702*c* may be set to differ from the brightness of frame 702*b*, the brightness of frame 704*c* may be set to differ from the brightness of frame 704*b*, and the brightness of frame 706*c* may be set to differ from the brightness of frame 706*b*. In this way, each of the three frames of each group of consecutive frames may have different brightness values. Each of frames 502*a*, 702*b*, and 702*c* will have different brightness values. Each of frames 504*a*, 704*b*, and 704*c* will have different brightness values. Each of frames 506*a*, 704*b*, and 704*c* will have different brightness values. The variety of different brightness levels within groups of consecutive frames may reduce the appearance of judder without significantly reducing the quality of the overall video.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing the terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general purpose computing apparatus to a specialized computing apparatus implementing one or more implementations of the present subject matter. Any suitable programming, scripting, or other type of language or combinations of languages may be used to implement the teachings contained herein in software to be used in programming or configuring a computing device.

Implementations of the methods disclosed herein may be performed in the operation of such computing devices. The order of the blocks presented in the examples above can be varied for example, blocks can be re-ordered, combined, or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or value beyond those recited. Headings, lists, and numbering included herein are for ease of explanation only and are not meant to be limiting.

It will also be understood that, although the terms "first," "second," etc. may be used herein to describe various objects, these objects should not be limited by these terms. These terms are only used to distinguish one object from another. For example, a first node could be termed a second node, and, similarly, a second node could be termed a first node, which changing the meaning of the description, so long as all occurrences of the "first node" are renamed consistently and all occurrences of the "second node" are renamed consistently. The first node and the second node are both nodes, but they are not the same node.

The terminology used herein is for the purpose of describing particular implementations only and is not intended to be limiting of the claims. As used in the description of the implementations and the appended claims, the singular forms "a," "an," and "the" are intended to include the plural forms as well, unless the context clearly indicates otherwise. It will also be understood that the term "or" as used herein refers to and encompasses any and all possible combinations of one or more of the associated listed items. It will be further understood that the terms "comprises" or "comprising," when used in this specification, specify the presence of stated features, integers, steps, operations, objects, or components, but do not preclude the presence or addition of one or more other features, integers, steps, operations, objects, components, or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

The foregoing description and summary of the invention are to be understood as being in every respect illustrative and exemplary, but not restrictive, and the scope of the invention disclosed herein is not to be determined only from the detailed description of illustrative implementations but according to the full breadth permitted by patent laws. It is to be understood that the implementations shown and described herein are only illustrative of the principles of the present invention and that various modification may be implemented by those skilled in the art without departing from the scope and spirit of the invention.

What is claimed is:

1. A method comprising:

at an electronic device having a processor:

identifying a plurality of subsets of consecutive frames of a video of frames, wherein at least some content appears in a same position in a first frame and a second frame of each of the subsets of consecutive frames based on the consecutive frames having been generated based at least in part on a frame rate conversion of source content to produce the video, the video having a faster frame rate than the source content;

based on the at least some content appearing in the same position in the first frame and the second frame of each of the subsets of consecutive frames, altering a display characteristic to display the content differently in the first frame and second frame of each of the subsets of consecutive frames, wherein the display characteristic is altered to differ in the consecutive frames of each of the subsets; and providing the video of frames for display based on the altered display characteristic.

2. The method of claim 1, wherein the altering comprises selectively altering only the display characteristic of a first object depicted in the consecutive frames without altering the display characteristic of a second object depicted in the consecutive frames.

3. The method of claim 2 further comprising determining to alter the display characteristic of the first object based on object altering selection criteria.

4. The method of claim 2 further comprising determining to alter the display characteristic of the first object based on a brightness of the first object.

5. The method of claim 2 further comprising determining to alter the display characteristic of the first object based on a movement of the first object in the video of frames.

6. The method of claim 1, wherein the consecutive frames comprise an original frame of a first video having a first frame rate and one or more duplicate frames of the original frame generated for displaying a second video at a second frame rate, the second frame rate higher than the first frame rate.

7. The method of claim 1, wherein the display characteristic comprises brightness, color, luminance, or dynamic range.

8. The method of claim 1, wherein altering the display characteristic comprises:

determining a first brightness for a first frame of the consecutive frames;

determining a second brightness for a second frame of the consecutive frames, wherein the second frame is after the first frame in a sequence of the consecutive frames; and altering the first frame according to the first brightness or altering the second frame according to the second brightness.

9. The method of claim 8, wherein the first brightness is brighter than the second brightness.

10. The method of claim 8, wherein the second brightness is brighter than the first brightness.

11. The method of claim 1, wherein altering the display characteristic comprises altering brightness, luminance, dynamic range, or color.

12. A system comprising:

a non-transitory computer-readable storage medium; and one or more processors coupled to the non-transitory computer-readable storage medium, wherein the non-transitory computer-readable storage medium comprises program instructions that, when executed on the one or more processors, cause the system to perform operations comprising:

identifying a plurality of subsets of consecutive frames of a video of frames, wherein at least some content appears in a same position in a first frame and a second frame of each of the subsets of consecutive frames based on the consecutive frames having been generated based at least in part on a frame rate conversion of source content to produce the video, the video having a faster frame rate than the source content;

altering a display characteristic to display the content differently in the first frame and second frame of each of the subsets of consecutive frames, wherein the display characteristic is altered to differ in the consecutive frames of each of the subsets; and providing the video of frames for display based on the altered display characteristic.

13. The system of claim 12, wherein the altering comprises selectively altering only the display characteristic of a first object depicted in the consecutive frames without altering the display characteristic of a second object depicted in the consecutive frames.

14. The system of claim 13 further comprising determining to alter the display characteristic of the first object based on a brightness of the first object.

15. The system of claim 13 further comprising determining to alter the display characteristic of the first object based on a movement of the first object in the video of frames.

16. The system of claim 12, wherein the consecutive frames comprise an original frame of a first video having a first frame rate and one or more duplicate frames of the original frames generated for displaying a second video at a second frame rate, the second frame rate higher than the first frame rate.

17. The system of claim 12, wherein altering the display characteristic comprises:

determining a first brightness for a first frame of the consecutive frames;

determining a second brightness for a second frame of the consecutive frames, wherein the second frame is after the first frame in a sequence of the consecutive frames; and altering the first frame according to the first brightness or altering the second frame according to the second brightness.

18. The system of claim 17, wherein the first brightness is brighter than the second brightness.

19. The system of claim 17, wherein the second brightness is brighter than the first brightness.

20. A non-transitory computer-readable storage medium, storing program instructions computer-executable on a computer to perform operations comprising:

identifying a plurality of subsets of consecutive frames of a video of frames, wherein at least some content appears in a same position in a first frame and a second frame of each of the subsets of consecutive frames based on the consecutive frames having been generated based at least in part on a frame rate conversion of source content to produce the video, the video having a faster frame rate than the source content;

based on the at least some content appearing in the same position in the first frame and the second frame of each of the subsets of consecutive frames, altering a display characteristic to display the content differently in the first frame and second frame of each of the subsets of consecutive frames, wherein the display characteristic is altered to differ in the consecutive frames of each of the subsets; and providing the video of frames for display based on the altered display characteristic.

21. The non-transitory computer-readable storage medium of claim 19, wherein the altering comprises selectively altering only the display characteristic of a first object depicted in the consecutive frames without altering the display characteristic of a second object depicted in the consecutive frames.

* * * * *